United States Patent [19]

Kitamura

[11] Patent Number: 4,621,021

[45] Date of Patent: Nov. 4, 1986

[54] POLYHEXAMETHYLENE ADIPAMIDE FIBER HAVING HIGH DIMENSIONAL STABILITY AND HIGH FATIGUE RESISTANCE, AND PROCESS FOR PREPARATION THEREOF

[75] Inventor: Kazuyuki Kitamura, Nobeoka, Japan

[73] Assignee: Asahi Kasei Kogyo Kabushiki Kaisha, Japan

[21] Appl. No.: 662,822

[22] Filed: Oct. 19, 1984

[30] Foreign Application Priority Data

Oct. 20, 1983 [JP] Japan ..... 58-195170
Oct. 20, 1983 [JP] Japan ..... 58-195171

[51] Int. Cl.[4] ..... D02G 3/00

[52] U.S. Cl. ..... 428/364; 152/525; 264/290.5; 264/210.8; 428/372

[58] Field of Search ..... 428/364, 372, 379; 264/210.7, 210.8, 176 F, 290.5

[56] References Cited

U.S. PATENT DOCUMENTS 2,807,863 10/1957 Schenker ..... 264/210.7 X
3,090,997 5/1963 Au ..... 264/210.7
3,091,015 5/1963 Zimmerman .
3,546,329 12/1970 Hirono et al. ..... 264/210.7 X

FOREIGN PATENT DOCUMENTS 32616 10/1973 Japan .

*Primary Examiner*—Lorraine T. Kendell

*Attorney, Agent, or Firm*—Finnegan, Henderson, Farabow, Garrett & Dunner

[57] ABSTRACT

A high-tenacity polyhexamethylene adipamide fiber is described, which has (1) a formic acid relative viscosity of 50 to 150, (2) a tensile strength of at least 7.5 g/d, (3) an intermediate elongation not larger than 8% under 5.3 g/d, (4) a difference between elongation (%) at break and intermediate elongation (%) under 5.3 g/d of at least 6%, and (5) a shrinkage factor not larger than 5% under dry heat conditions at 160° C. Preferably, the fiber has (6) an elongation of 12 to 20%, (7) a dimensional stability not larger than 13%, (8) a crystal orientation degree of at least 0.85 but not larger than 0.92, (9) a crystal perfection index of at least 60%, and (10) the peak temperature Tmax of the dynamic mechanical loss tangent (tan δ), as measured at a frequency of 110 Hz, satisfying the formula:

$$100 \leqq T_{max} + 4(9.5 - DS) \leqq 116$$

wherein DS is for the tensile strength (g/d). This fiber is prepared by melting polyhexamethylene adipamide having a formic acid relative viscosity of 50 to 150, extruding the melt from a spinneret, cooling the extrudate to be thereby solidified, winding the resulting filament yarn at a take-up speed of 1000 to 6000 m/min, and then heat-drawing the filament yarn at a drawing speed not higher than 100 m/min.

3 Claims, 4 Drawing Figures

POLYHEXAMETHYLENE ADIPAMIDE FIBER HAVING HIGH DIMENSIONAL STABILITY AND HIGH FATIGUE RESISTANCE, AND PROCESS FOR PREPARATION THEREOF

BACKGROUND OF THE INVENTION (1) Field of the Invention

The present invention relates to a polyhexamethylene adipamide fiber and a process for the preparation thereof. More particularly, it relates to a polyhexamethylene adipamide fiber having high dimensional stability and fatigue resistance, which is used as a rubber reinforcer for a tire cord, a belt or the like, and a process for the preparation thereof.

(2) Description of the Prior Art

Since a polyhexamethylene adipamide fiber is excellent in tensile strength, toughness, heat resistance, dyeability and colorability, it is broadly used as an industrial material, an interior bedding mateial, a clothing fiber and the like. Especially, since it is excellent in tensile strength, toughness, fatigue resistance and adhesion to rubber, it is widely used as a fiber for tire cords.

Recently, an energy-saving effect is desired even in tire cords and development of tires capable of reducing the fuel consumption in automobiles is required. Accordingly, efforts have been made by tire makers to provide tires having a smaller rolling resistance and a lighter weight. Accordingly, yarns having a higher dimensional stability and a higher tensil strength have been desired for the production of tire cords. Improvement of the durability of tires is necessary not only for attaining an economical effect by prolonging lives of tires but also for improving the safety, and from this viewpoint, yarns having a high fatigue resistance are desired.

A nylon 66 fiber is excellent over a nylon 6 fiber in the heat resistance and dimensional stability and also excellent over a polyethylene terephthalate fiber in the heat resistance, especially the heat resistance under high humidity conditions, and the amine decomposition resistance. However, the nylon 66 fiber is defective in that the fiber is inferior to the polyethylene terephthalate fiber in the dimensional stability. Therefore, in the field of radial carcasses where dimensional stability is required, steel, polyethylene terephtalate and rayon have mainly been used. Since steel and rayon are low in the tensile strength per unit weight, the amount used of cords per tire is increased, resulting in increase of the tire weight and the cost. Polyethylene terephthalate is poor in the heat resistance, especially the heat resistance under high humidity conditions, and therefore, use of polyethylene terephthalate fibers is restricted for truck or bus tires and high-speed tires where the running temperature is high. Under this background, it has been required to improve the dimension stability of a nylon 66 fiber while retaining excellent properties thereof, such as high tensile strength, high heat resistance and high fatigue resistance.

A method for improving the dimensional stability and fatigue resistance of a polyester yarn is disclosed in Japanese Unexamined Patent Publication No. 53-58032. In this method, a polyester composed mainly of polyethylene terephthalate is melt-spun under a high stress and the resulting undrawn filament yarn having a relatively high birefringence of $9\times10^{-3}$ to $70\times10^{-3}$ is heat-drawn. As the speed of taking up the undrawn yarn, there is adopted a speed of 1000 to 2000 m/min.

After issuance of the above unexamined patent publication, various investigations have been made to improve the dimensional stability and fatigue resistance by drawing high-speed melt-spun yarns. In connection with polyhexamethylene adipamide fibers, Japanese Unexamined Patent Publication No. 58-60012 discloses a method comprising melt-spinning polyhexamethylene adipamide, taking up the spun filament yarn at a speed higher than 2000 m/min and then drawing the filament yarn. However, if the orientation degree of the spun yarn is increased by increasing the spinning speed, the drawability is worsened. This tendency is especially prominent in polyhexamethylene adipamide having a very high crystallization rate. Accordingly, polyhexamethylene adipamide is defective in that the higher the spinning speed, the lower the tensile strength and elongation of the obtained drawn yarn. The inherent function of a tire cord is a reinforcing action, and if the tensile strength and elongation of the tire cord are reduced, it becomes necessary to increase the amount of the yarn used in a tire, resulting in increase of the tire weight and the manufacturing cost.

SUMMARY OF THE INVENTION

It is therefore a primary object of the present invention to provide a polyhexamethylene adipamide fiber excellent in the tensile strength, elongation, dimensional stability and fatigue resistance.

Other objects and advantages of the present invention will be apparent from the following description.

In accordance with one fundamental aspect of the present invention, there is provided a polyhexamethylene adipamide fiber characterized by having (1) a formic acid relative viscosity of 50 to 150, (2) a tensile strength of at least 7.5 g/d, (3) an intermediate elongation not larger than 8% under a stress of 5.3 g/d, (4) a difference between elongation (%) at break and intermediate elongation (%) under 5.3 g/d of at least 6%, and (5) a shrinkage factor not larger than 5% under dry heat conditions at 160° C.

A preferred polyhexamethylene adipamide fiber is further characterized by having (6) an elongation of from 12 to 20%, (7) a dimensional stability not larger than 13%, (8) a crystal orientation degree of at least 0.85 but not larger than 0.92, (9) a crystal perfection index (CPI) of at least 60%, and (10) the peak temperature Tmax of the dynamic mechanical loss tangent (tan δ) as measured at a frequency of 110 Hz satisfying the requirement of the following formula:

$$100 \leqq T_{max} + 4(9.5 - DS) \leqq 116$$

wherein DS stands for the tensile strength (g/d).

In accordance with another fundamental aspect of the present invention, there is provided a process for the preparation of a polyhexamethylene adipamide fiber, which comprises melting polyhexamethylene adipamide having a formic acid relative viscosity of 50 to 150, extruding the melt from a spinneret, cooling the extrudate to be thereby solidified, winding the resulting filament yarn at a take-up speed of 1000 to 6000 m/min, and then heat-drawing the filament yarn at a drawing speed not higher than 100 m/min.

DESCRIPTION OF THE PREFERRED EMBODIMENTS

Figure 1:
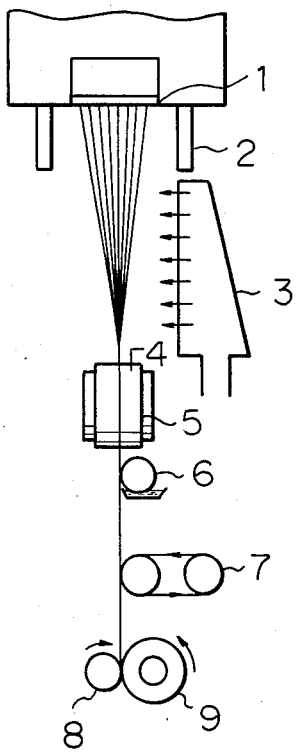
FIG. 1 is a diagrammatic view of a typical melt-spinning apparatus used for the production of an undrawn yarn of polyhexamethylene adipamide according to the present invention.

Polyhexamethylene adipamide used in the present invention consists mainly of recurring units of the following formula:

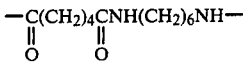

Polyhexamethylene adipamide modified by incorporating up to 10% by weight of other amide-forming units as part of the recurring units can also be used in the present invention. As this amide-forming component to be incorporated in a small amount, there can be mentioned aliphatic dicarboxylic acids such as sebacic acid and dodecanoic acid, aromatic dicarboxylic acids such as terephthalic acid and isophthalic acid, aliphatic diamines such as decamethylene diamine, aromatic diamines such as metaxylylene diamine, ω-aminocarboxylic acids such as ϵ-aminocaproic acid, and lactams such as caprolactam and lauryl lactam. Furthermore, a blend of polyhexamethylene adipamide with up to 20% by weight of other polyamide such as polycapramide or polyhexamethylene sebacamide may be used.

Moreover, customary additives, for example, copper compounds such as copper acetate, copper chloride, copper iodide and 2-mercaptobenzimidazole-copper complex, heat stabilizers such as 2-mercaptobenzimidazole and tetrakes-[methylene-3-(3,5-di-tert-butyl-4-hydroxyphenyl)-propionato]-methane, light stabilizers such as manganese lactate and manganese hypophosphite, thickening agents such as phosphoric acid, phenylphosphonic acid and sodium pyrophosphate, delustering agents such as titanium dioxide and kaolin, lubricants such as ethylenebis-stearylamide and calcium stearate, and plasticizers, may be incorporated in the above-mentioned polyhexamethylene adipamide.

It is indispensable that the formic acid relative viscosity of polyhexamethylene adipamide used in the present invention should be 50 to 150. By the term "formic acid relative viscosity" referred to herein is meant a solution relative viscosity of a solution formed by dissolving the polymer in 90% formic acid at a concentration of 8.4% by weight at a temperature of 25° C. If the formic acid relative viscosity is lower than 50, the fatigue resistance of the obtained polyhexamethylene adipamide fiber is extremely poor. If the formic acid relative viscosity exceeds 150, the drawability is low and a starting yarn having a sufficient strength cannot be obtained, and the dimensional stability is also low. It is preferred that the formic acid relative viscosity of polyhexamethylene adipamide is 60 to 100.

The above-mentioned polymer dried to a water content not larger than 0.1% is melt-spun by using an extruder type spinning machine, or the molten polymer as-obtained by continuous polymerization is guided through a conduit to a spin head whereby the polymer is directly spun. At this spinning step, the temperature of the melt is preferably 270° to 320° C. The extrudate is cooled by cold air to be thereby solidified, and an oiling agent is applied thereto. The filament yarn is taken up by a take-up roller and is then wound. The yarn may be directly wound on a winder after application of the oiling agent without using the take-up roller.

It is indispensable that the winding speed should be 1000 to 6000 m/min. If the winding speed is lower than 1000 m/min, the improvement in the fatigue resistance and dimensional stability of the drawn fiber is small. If the winding speed exceeds 6000 m/min, the strength and elongation of the drawn yarn are low. It is preferred that the winding speed be not higher than 5000 m/min.

In case of a polyhexamethylene adipamide fiber, if the spinning speed is about 600 to about 4000 m/min, the wound yarn is elongated by absorption of the moisture, and normal winding therefore becomes impossible. Accordingly, if the winding speed is 1000 to 4000 m/min, there should be adopted a method in which the cooled yarn is steam-set and is then wound, or a method in which the spun yarn is taken up by the take-up roller, then drawn at a draw ratio not larger than 2.0 between the take-up roller and subsequent roller and then wound.

If the winding speed exceeds 4500 m/min, the winding tension is increased, and a paper spool cannot be taken out from the winding machine because of shrinkage of the yarn or the selvage rises in the portions close to the end faces of a cheese of the wound yarn. This tendency is especially conspicuous if the winding speed exceeds 5000 m/min. In this case, it is necessary to adopt a method in which the spun yarn is taken up by the take-up roller, the yarn is relaxed by up to 10% between the take-up roller and subsequent rollers and the yarn is then wound.

In the process of the present invention, it is preferred that the birefringence of the highly oriented polyhexamethylene adipamide undrawn yarn before the drawing operation is $20\times10^{-3}$ to $50\times10^{-3}$. If this birefringence is smaller than $20\times10^{-3}$, the improvement of the fatigue resistance and dimension stability of the drawn fiber is small. If this birefringence exceeds $50\times10^{-3}$, manifestation of the strength is insufficient, however, contrived the drawing method may be as in the present invention. It is especially preferred that the above-mentioned birefringence is $25\times10^{-3}$ to $45\times10^{-3}$ At the step of drawing an undrawn yarn having a large denier, such as a tire cord, there is ordinarily adopted a drawing speed of several hundred to several thousand meters per minute on the final drawing roller. Increase of the drawing speed results in increase of the productivity, and recently, the drawing speed has been elevated to a level of several thousand meters per minute by adoption of a direct spinning-drawing process. As the result of our investigations, however, it has been found that when a highly oriented, undrawn yarn is drawn, influences of the drawing speed on the physical properties of the drawn yarn are much more serious than in the case where a lowly oriented, undrawn yarn is drawn. In order to obtain the fiber of the present invention, it is indispensable that the drawing speed on the final drawing roller should be not higher than 100 m/min. If the drawing speed exceeds this critical level, manifestation of the strength and elogation in the obtained fiber is insufficient, and the fatigue resistance and dimensional stability thereof are degraded. It is especially preferred that the drawing speed be not higher than 50 m/min.

If the drawing speed is too low, no defects are brought about in connection with the physical properties of the fiber, but the productivity is extremely reduced. Accordingly, from the practical viewpoint, the drawing speed should be at least 2 m/min.

In the present invention, either single-stage drawing or multiple-stage drawing including at least two stages may be adopted. Recently, in the production of high tenacity yarns for tire cords, multiple-stage drawing has been adopted for obtaining high tenacity yarns. According to the process of the present invention, a yarn having sufficient tenacity, fatigue resistance and dimensional stability can be obtained by single-stage drawing. If single-stage drawing is adopted, the equipment can be simplified and an energy-saving effect can be attained.

As the drawing roller means used in the present invention, there can be mentioned a Nelson roller unit comprising two pairs of positively driven rollers, a drawing unit comprising positively driven rollers and free rollers in combination, and a roller unit comprising 5 to 9 positively driven rollers, which is customarily used for staple fiber yarns or monofilament yarns.

A feed roller is preferably arranged before the drawing roller so as to impose a tension on a yarn to be drawn, and it is preferred that stretching of less than 5% is given to the yarn between the feed roll and the drawing roller. Of course, there may be adopted a method in which three or more stages of drawing rollers are arranged and stretching of less than 5% is effected between the first stage drawing roller and the second stage drawing roller.

The first stage drawing roller is preferably mirror-polished, and drawing rollers of the second and subsequent stages have preferably a mirror-polished surface or a satin-finished surface of not more than 10 S. Furthermore, mirror-polished surface and satin-finished surfaces may be arranged alternately on the drawing rollers of the second and subsequent stages. In case of a Nelson roller unit or a roller unit comprising positively driven rollers and free rollers in combination, the yarn is wound on the drawing rollers by 2 to 7 turns. The turn number may be small in mirrorpolished rollers, and the turn number is increased as the roughness is increased in the satin-finished rollers. A turn number larger than 7 may be adopted, but in this case, the roller length is increased and the process becomes economically disadvantageous.

Ordinarily, the drawing roller is maintained at a temperature higher than room temperature. In the conventional process for drawing a highly oriented, undrawn yarn, such as disclosed in Japanese Unexamined Patent Publication No. 58-60012, the first drawing roller is maintained at 80° to 150° C. and the second drawing roller is maintained at 160° to 240° C. Of course, in the present invention, these temperatures may be adopted for the drawing rollers, but even if the drawing rollers are maintained at room temperature, drawing can be perfofmed smoothly without any trouble in the present invention provided that a yarn heater is used. Therefore, the equipment can be simplified and an energy-saving effect can be attained.

In a preferred process of the present invention, a yarn-heater is arranged between drawing rollers to effect heat drawing. The yarn-heater may be either the contact type or the non-contact type. In case of the contact type heating, the temperature of the heater is 180° to 260° C., and in case of the non-contact type heating, the temperature of the heater is 200° to 280° C. In case of the contact type heating, if the temperature of the heating member is lower than 180° C., sufficient drawing cannot be accomplished, and if the temperature of the heating member is higher than 260° C., breakage of the yarn is caused by fusion. In case of the non-contact type heating, if the temperature of the heating member is lower than 200° C., sufficient drawing cannot be accomplished. If the temperature of the heater is higher than 280° C., the yarn is broken by fusion. Ordinarily, a hot plate is frequently used as a yarnheater. In the conventional process, the temperature of the hot plate is maintained at 180° to 220° C. For example, in the process disclosed in Japanese Unexamined Patent Publication No. 58-60012, temperatures in the range of from 150° to 210° C. are adopted. Also in the present invention, temperatures of from 180° to 230° C. in case of the contact type heating and temperatures of from 200° to 240° C. in case of the non-contact type heating may be adopted. However, in order to obtain a fiber having higher strength and elongation and higher dimensional stability, higher temperatures are preferably adopted for the yarn-heater. Namely, it is preferred that a temperature of 230° to 255° C. in case of the contact type heating and a temperature of 240° to 275° C. in case of the non-contact type heating is adopted. If the temperature of the yarn-heater of the contact type is elevated, a tarry substance derived from a finishing agent applied to the yarn is readily deposited on the yarn-heater. Accordingly, it is preferred that the non-contact type heating is adopted.

Figure 2:
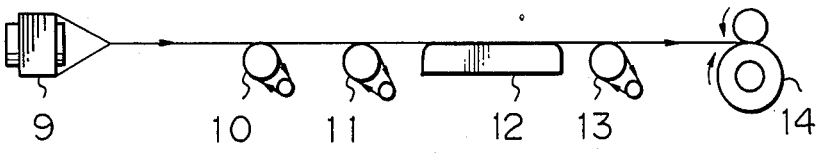
FIG. 2 is a diagrammatic view of a heat drawing apparatus used for one stage drawing.
Figure 3:
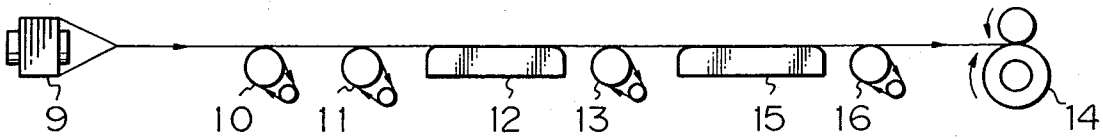
FIG. 3 is a diagrammatic view of a heat drawing apparatus used for two stage drawing.

A preferred embodiment of the process of the present invention will now be described with reference to the accompanying drawings. FIG. 1 shows the melt-spinning step, FIG. 2 shows the drawing step of the one-step drawing process, and FIG. 3 shows the drawing step of the two-stage drawing process. Of course, the scope of the present invention is not limited by the embodiment illustrated in the drawings.

Referring to FIG. 1, molten polyhexamethylene adipamide is extruded from a spinneret 1 having many fine orifices and is passed through an atmosphere maintained at a temperature adjusted by a heating cylinder 2 arranged just below the spinneret. Then, the extrudate is cooled to be thereby solidified by cold air blown out at a constant rate from a cold air chamber 3 and is then set by steam 4 blown into a steam conditioner 5. A finishing agent is applied to the formed yarn by an oiling roller 6. The formed yarn is taken up by take-up rollers 7 and wound as an undrawn yarn package 9 by a winder 8.

The thus-wound undrawn yarn package 9 is supplied to a drawing heat treatment apparatus as a starting yarn to be used at the drawing step shown in FIG. 2. The yarn unwound from the undrawn yarn package is supplied to a feed roller 10 and stretching of several % is given to the yarn between the feed roller 10 and a first drawing roller 11. A yarn-heater 12 is arranged between the first drawing roller 11 and a second drawing roller 13, and the yarn is heat-drawn between the first drawing roller 11 and the second drawing roller 13 and is wound as a drawn yarn 14.

Furthermore, the undrawn yarn package 9 is similarly supplied to a drawing heat treatment apparatus as a starting yarn to be used at the drawing step shown in FIG. 3. The yarn unwound from the undrawn yarn package 9 is supplied to a feed roller 10, and stretching of several % is given between the feed roller 10 and a first drawing roller 11. A yarn-heater 12 is arranged between the first drawing roller 11 and a second drawing roller 13 and another yan-heater 15 is arranged between the second drawing roller 13 and the third drawing roller 16. The yarn is drawn in two stages between the first and second drawing rollers and between the second and third drawing rollers, and the yarn is wound as drawn yarn 14. In the embodiment shown in FIG. 3, the yarn may be heat-treated under a relax of up to 15% between the second drawing roller and the third drawing roller.

Figure 4:
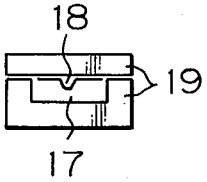
FIG. 4 is a sectional view of a non-contact type heater.

FIG. 4 is a sectional view showing a heater of the non-contact type. The yarn is heated while the yarn is travelled through a yarn groove 18 surrounded by a heater 17 and a heat-insulating member 19.

The polyhexamethylene adipamide fiber prepared according to the above-mentioned process is characterized by having (1) a formic acid relative viscosity of 50 to 150, (2) a tensile strength of at least 7.5 g/d, usually 7.5 g/d to 10.5 g/d, (3) an intermediate elongation not larger than 8%, usually about 6% to 8%, under a stress of 5.3 g/d, (4) a difference between elongation (%) at break and intermediate elongation (%) under 5.3 g/d of at least 6%, usually 6% to about 10%, and (5) a shrinkage factor not larger than 5%, usually about 2% to 5%, under dry heat conditions at 160° C. Preferably, the fiber is further characterized in that (6) the dimensional stability is not larger than 13%, (7) the elongation is 12 to 20%, (8) the crystal perfection index (CPI) is at least 60%, usually 60% to about 80%, (9) the crystal orientation degree is at least 0.85 but not larger than 0.92, and (10) the peak temperature Tmax of the dynamic mechanical loss tangent (tan δ) as measured at a frequency of 110 Hz satisfying the requirement of the following formula:

$$100 \leqq \mathrm{Tmax} + 4(9.5 - \mathrm{DS}) \leqq 116$$

wherein DS stands for the tensile strength (g/d).

The formic acid relative viscosity is a relative viscosity as measured at 25° C. on a polymer solution formed by dissolving the polyemr at a concentration of 8.4% by weight in 90% formrc acid. Each of the tensile strength, elongation and intermediate elongation is determined by using an autographic recording device (Model S-100 supplied by Shimazu Corp.) at a yarn length of 25 cm, a falling speed of 30 cm/min and a chart speed of 60 cm/min on a sample yarn twisted at 80 T/m, which has been previously conditioned for 24 hours in a chamber maintained at a temperature of 20° C. and a relative humidity of 65%. The shrinkage factor under dry heat conditions is determined on a sample yarn, which has been previously conditioned for 24 hours in a chamber maintained at a temperature of 20° C. and a relative humidity of 65%, by allowing 1.0 m, measured under a load (initial load) corresponding to 1/20 gram per denier of the sample yarn, of the sample yarn to freely shrink for 30 minutes in an air oven maintained at 160° C., conditioning the sample yarn in the above-mentioned chamber for 4 hours and measuring the length of the sample yarn under the same load as the initial load.

The dimensional stability is expressed by the sum of the intermediate elongation under 5.3 g/d and the shrinkage factor under dry heat conditions at 160° C.

The crystal orientation degree is determined by using a CuKα ray in a wide angle X-ray scattering apparatus (supplied by Rigaku Denki) and is calculated from the half value width $H^o$ of the intensity distribution along the Debye ring of interference of the equatorial line (1,0,0) according to the following formula:

$$f_c = \frac{180° - H°}{180°}$$

The crystal perfection index is determined by using CuKα ray in a wide angle X-ray scattering apparatus (supplied by Rigaku Denki) and is calculated from crystal spacings d(100) and d[(010)+(110)] of the face of (1,0,0) and the faces of [(0,1,0)+(1,1,0)] according to the following formula:

$$\frac{d(100)/d[(010) + (110)] - 1}{0.189} \times 100(\%)$$

The temperature Tmax is the peak temperature of the dynamic mechanical loss tangent (tan ε) as measured at a frequency of 110 Hz and a temperature-elevating rate of 3° C./min in dry air by using Vibron DDV-IIC supplied by Toyo Baldwin.

Although the polyhexamethylene adipamide fiber of the present invention has a low elongation under a constant stress of 5.3 g/d (intermediate elongation under a stress of 5.3 g/d) and a high rigidity, the shrinkage factor of the fiber is low. Accordingly, the fiber of the present invention has a high dimensional stability. Furthermore, although the fiber of the present invention has a low intermediate elongation, the elongation at break is high and the breaking energy is large. The crystal orientation of the fiber of the present invention is not substantially different from that of the conventional yarn, but the crystal perfection index of the fiber of the present invention is high and the amorphous portion is loose and easily movable. The peak temperature Tmax which is a factor indicating the mobility of the amorphous portion is varied by stretching of the fiber, and therefore, the peak temperature should be corrected according to the tensile strength so as to know the inherent mobility of the fiber. The correction is 4° C. per g/d of the tensile strength.

The fiber of the present invention is excellent in the dimensional stability, fatigue resistance, tensile strength and elongation over a conventional yarn obtained by drawing a high-speed spun, undrawn yarn at a speed of several hundred to several thousand meters per minutes. Therefore, the fiber is useful for a tire cord or belt.

The present invention will now be described in detail with reference to the following examples that by no means limit the scope of the invention.

The properties of treated cords were measured measurement without twisting of 80 T/m as in case of the of the properties of starting filament yarns. In case of starting filament yarns, the intermediate elongation was determined under 5.3 g/d, but in case of treated cords, the intermediate elongation was determined under 2.65 g/d. The fatigue resistance was determined by Goodyear tube fatigue test according to the method 3.2.2.1A of JIS L-1017 under the following conditions.

Shape of Tube:
- Inner diameter: 12.5 mm
- Outer diameter: 26 mm
- Length: 230 mm Bending Angle: 90°
Inner Pressure: 3.5 $Kg/cm^2G$
Rotation Number: 850 rpm The fatigue test was conducted under the above conditions and the time required for rupture of the tube was measured.

EXAMPLE 1

A 50% aqueous solution of hexamethylene diammonium adipamide was supplied at a constant rate of 2000 parts per hour and concentrated to 70% in a concentrating tank, and the temperature was elevated from 220° C. to 250° C. over a period of 1.5 hours in the first reaction vessel while maintaining the pressure at 17.5 Kg/cm$^2$. Then, in the second reaction vessel, the pressure was returned to the atmospheric pressure while elevating the temperature to 280° C. Steam was separated in a gas-liquid separator, and polymerization was carried out at 280° C. under 350 mmHg for 15 minutes in a polymerization vessel. The reactin mixture was guided to a spinning head through a conduit and spun from a spinneret having 624 orifices having a diameter of 0.27 mm at 298° C. The formic acid relative viscosity of the extrudate was 65. Immediately, the extrudate was cooled and treated with steam, and an oiling agent was applied to the yarn, and the yarn was taken up on a take-up roller rotated at a take-up speed shown in Table 1 and is wound at the same speed as the take-up speed. Then, the undrawn yarn was stretched by 1% between a feed roller maintained at room temperature and the first drawing roller maintained at room temperature and then is drawn at a draw ratio shown in Table 1 between the first drawing roller and the second drawing roller maintained at room temperature. A hot plate maintained at 238° C. and having a length of 250 mm was arranged between the first drawing roller and the second drawing roller. The drawing speed was 15 m/min as the peripheral speed of the second drawing roller. The draw ratio was a maximum draw ratio at which no yarn breakage is caused for 15 minutes. The properties of the obtained drawn yarn are shown in Table 1.

First twists of 32.0 T/10 cm were given to the thus-obtained starting yarn of 1890 d, and two of these twisted yarns were doubled and twisted at a twist number of 32.0 T/10 cm to form a greige cord. By using a Computreater of Ritzlar Co., the greige cord was subjected to a dip treatment with a resorcinol-fomalin latex at 160° C. under a tension of 2.0 kg/cord for 140 seconds in the first zone, at 230° C. under a tension of 3.8 Kg/cord for 40 seconds in the second zone and at 230° C. under a tension of 2.6 Kg/cord for 40 seconds. The amount of the adhesive applied was 4.5%. The physical properties of the treated cord are shown in Table 2.

It is seen that a spinning speed higher than 1000 m/min, the crystal perfection index was increased and the peak temperature Tmax was lowered, and that excellent dimensional stability and fatigue resistance could be attained. It also is seen that the higher the spinning speed, the more improved the dimensional stability and fatigue resistance.

TABLE 1

| | | | | Properties of Drawn Yarn | | | | | | | |
|---|---|---|---|---|---|---|---|---|---|---|---|
| Run No. | Spinning Speed (m/min) | Birefringence $\Delta n$ ($\times 10^{-3}$) of Undrawn Yarn | Draw Ratio | Tensile Strength (g/d) | Elongation (%) | Intermediate Elongation (%) under 5.3 g/d | Shrinkage Factor (%) under Dry Heat Conditions | Dimensional Stability (%) | Crystal Orientation Degree | Crystal perfection Index (%) | $T_{max}$ (°C.) |
| 1 | 500 | 9 | 5.8 | 10.0 | 16.5 | 9.0 | 6.3 | 15.3 | 91.4 | 61.3 | 119 |
| 2 | 1000 | 20 | 4.4 | 9.5 | 16.7 | 8.0 | 5.3 | 13.3 | 90.7 | 67.2 | 114 |
| 3 | 1500 | 32 | 3.3 | 9.3 | 16.4 | 7.6 | 4.5 | 12.1 | 91.3 | 71.3 | 111 |
| 4 | 2000 | 38 | 3.1 | 9.1 | 15.4 | 7.4 | 4.4 | 11.8 | 91.0 | 73.7 | 110 |
| 5 | 3000 | 42 | 2.5 | 8.8 | 15.3 | 7.4 | 4.2 | 11.6 | 91.2 | 73.8 | 108 |
| 6 | 4000 | 43 | 2.1 | 8.6 | 15.0 | 7.3 | 4.0 | 11.3 | 90.2 | 73.6 | 107 |
| 7 | 4500 | 43 | 2.1 | 8.4 | 14.7 | 7.3 | 3.8 | 11.1 | 89.8 | 73.3 | 108 |
| 8 | 5000 | 44 | 2.0 | 8.1 | 14.0 | 7.3 | 3.8 | 11.1 | 88.1 | 73.9 | 106 |

TABLE 2

| | Properties of Treated Cord | | | | | |
|---|---|---|---|---|---|---|
| Run No. | Tensile Strength (g/d) | Elongation (%) | Intermediate Elongation (%) | Shrinkage Factor (%) under Dry Heat Conditions | Dimensional Stability (%) | GY Fatigue Life (minutes) |
| 1 | 8.2 | 21.4 | 8.8 | 4.7 | 13.5 | 480 |
| 2 | 8.1 | 20.0 | 8.5 | 4.0 | 12.5 | 750 |
| 3 | 8.0 | 20.0 | 8.4 | 3.5 | 11.9 | 980 |
| 4 | 7.9 | 19.7 | 8.3 | 3.3 | 11.6 | 1350 |
| 5 | 7.8 | 19.7 | 8.2 | 3.1 | 11.3 | 1590 |
| 6 | 7.6 | 19.5 | 8.0 | 3.1 | 11.1 | 1610 |
| 7 | 7.5 | 19.0 | 8.0 | 3.0 | 11.0 | 1460 |
| 8 | 7.2 | 18.5 | 8.0 | 2.8 | 10.8 | 1490 |

EXAMPLE 2

An undrawn yarn was prepared in the same manner as described in Example 1 except that the spinning speed was varied to 1500 m/min or 3000 m/min, and the undrawn yarn was drawn according to the drawing method described in Example 1 at a drawing speed shown in Table 3 and 4. A treated cord was prepared from the thus-obtained drawn yarn in the same manner as described in Example 1. The results are shown in Tables 3 through 6.

It is seen that if the drawing speed exceeded 100 m/min, the crystal perfection index, tensile strength, elongation, dimensional stability and fatigue resistance were reduced.

COMPARATIVE EXAMPLE 1

An undrawn yarn was prepared in the same manner as described in Example 1 except that the spinning speed was veried to 1500 m/min or 3000 m/min. The undrawn yarn was taken up on the first Nelson roller and consecutively guided to the second through fourth rollers where the peripheral rotation speed was gradually increased, so that heat draw setting was carried out in three stages. The resulting drawn yarn, was wound at a speed of 1500 m/min. The first through fourth Nelson rollers consisted of Goddet roller pairs G1 through G4, respectively. The Goddet roller pairs G1 through G4 were maintained at room temperature, 80° C., 220° C. and 230° C., respectively. The peripheral speed ratio G2/G1 between the Goddet roller pairs G2 and G1 was 1.01, the peripheral speed ratio G3/G2 between the Goddet roller pairs G3 and G2 was variable, the peripheral speed ratio G4/G3 between the Goddet roller pairs G4 and G3 was 1.6, and the ratio of the winding speed to the peripheral speed of the Goddet roller pair G4 was 0.95. The drawn yarn was treated in the same manner as described in Example 1 to obtain a treated cord. The results are shown in Table 3 through 6.

It is seen that the crystal perfection index, tensile strength, dimensional stability and fatigue resistance were lower than those obtained in Example 2.

TABLE 3

| | | | | Properties of Drawn Yarn | | | | | | | |
|---|---|---|---|---|---|---|---|---|---|---|---|
| Run No. | Spinning Speed (m/min) | Drawing Speed (m/min) | Draw Ratio | Tensile Strength (g/d) | Elongation (%) | Intermediate Elongation (%) | Shrinkage Factor (%) under Dry Heat Conditions | Dimensional Stability (%) | Crystal Orientation Degree | Crystal Perfection Index (%) | $T_{max}$ (°C.) |
| 9 | 1500 | 10 | 3.3 | 9.3 | 16.6 | 7.5 | 4.3 | 11.8 | 91.4 | 72.5 | 110 |
| 10 | 1500 | 20 | 3.3 | 9.3 | 16.4 | 7.6 | 4.4 | 12.0 | 91.2 | 71.0 | 111 |
| 11 | 1500 | 30 | 3.3 | 9.3 | 16.3 | 7.6 | 4.4 | 12.0 | 90.8 | 70.8 | 110 |
| 12 | 1500 | 50 | 3.3 | 9.2 | 16.0 | 7.7 | 4.6 | 12.3 | 91.0 | 68.6 | 111 |
| 13 | 1500 | 100 | 3.25 | 9.0 | 15.7 | 7.8 | 5.0 | 12.8 | 90.7 | 61.4 | 112 |
| 14 | 1500 | 500 | 3.20 | 8.7 | 14.3 | 7.9 | 5.7 | 13.6 | 89.3 | 50.6 | 113 |
| Comparison 1 | 1500 | 1500 | 3.20 | 9.0 | 14.0 | 8.3 | 5.2 | 13.5 | 89.8 | 51.7 | 113 |

TABLE 4

| | | | | Properties of Drawn Yarn | | | | | | | |
|---|---|---|---|---|---|---|---|---|---|---|---|
| Run No. | Spinning Speed (m/min) | Drawing Speed (m/min) | Draw Ratio | Tensile Strength (g/d) | Elongation (%) | Intermediate Elongation (%) | Shrinkage Factor (%) under Dry Heat Conditions | Dimensional Stability (%) | Crystal Orientation Degree | Crystal Perfection Index (%) | $T_{max}$ (°C.) |
| 15 | 3000 | 10 | 2.5 | 8.8 | 15.8 | 7.4 | 3.9 | 11.3 | 91.4 | 73.4 | 107 |
| 16 | 3000 | 20 | 2.5 | 8.8 | 15.4 | 7.4 | 4.2 | 11.6 | 91.2 | 73.5 | 108 |
| 17 | 3000 | 30 | 2.5 | 8.7 | 15.3 | 7.4 | 4.3 | 11.7 | 90.9 | 72.4 | 108 |
| 18 | 3000 | 50 | 2.45 | 8.6 | 15.0 | 7.6 | 4.3 | 11.9 | 90.7 | 69.2 | 107 |
| 19 | 3000 | 100 | 2.4 | 8.4 | 14.7 | 7.8 | 4.6 | 12.4 | 90.8 | 62.7 | 107 |
| 20 | 3000 | 500 | 2.3 | 8.3 | 13.9 | 8.0 | 5.3 | 13.3 | 88.9 | 52.5 | 107 |
| Comparison 2 | 3000 | 1500 | 2.3 | 8.4 | 14.0 | 8.6 | 4.7 | 13.3 | 89.6 | 54.3 | 108 |

TABLE 5

| | Properties of Treated Cord | | | | | |
|---|---|---|---|---|---|---|
| Run No. | Tensile Strength (g/d) | Elongation (%) | Intermediate Elongation (%) | Shrinkage Factor (%) under Dry Heat Conditions | Dimensional Stability (%) | GY Fatigue Life (minutes) |
| 9 | 8.0 | 20.6 | 8.4 | 3.1 | 11.5 | 1010 |
| 10 | 8.0 | 20.0 | 8.3 | 3.5 | 11.8 | 998 |
| 11 | 8.0 | 20.1 | 8.3 | 3.4 | 11.7 | 980 |
| 12 | 7.9 | 19.8 | 8.4 | 3.5 | 11.9 | 950 |
| 13 | 7.7 | 19.7 | 8.5 | 3.7 | 12.2 | 880 |
| 14 | 7.5 | 19.0 | 8.6 | 4.1 | 12.7 | 760 |
| Comparison 1 | 7.6 | 18.4 | 8.6 | 4.0 | 12.6 | 770 |

TABLE 6

| | Properties of Treated Cord | | | | | |
|---|---|---|---|---|---|---|
| Run No. | Tensile Strength (g/d) | Elongation (%) | Intermediate Elongation (%) | Shrinkage Factor (%) under Dry Heat Conditions | Dimensional Stability (%) | GY Fatigue Life (minutes) |
| 15 | 7.8 | 20.2 | 8.2 | 2.9 | 11.1 | 1750 |
| 16 | 7.8 | 19.8 | 8.1 | 3.1 | 11.2 | 1500 |
| 17 | 7.8 | 19.8 | 8.1 | 3.2 | 11.3 | 1420 |
| 18 | 7.7 | 19.6 | 8.2 | 3.2 | 11.4 | 1320 |
| 19 | 7.5 | 19.4 | 8.3 | 3.4 | 11.7 | 1100 |

TABLE 6-continued

| Run No. | Properties of Treated Cord | | | | | |
|---|---|---|---|---|---|---|
| | Tensile Strength (g/d) | Elongation (%) | Intermediate Elongation (%) | Shrinkage Factor (%) under Dry Heat Conditions | Dimensional Stability (%) | GY Fatigue Life (minutes) |
| 20 | 7.3 | 18.5 | 8.6 | 3.8 | 12.4 | 920 |
| Comparison 2 | 7.5 | 18.0 | 8.6 | 3.5 | 12.1 | 950 |

EXAMPLE 3

The undrawn yarn obtained at a spinning speed of 1500 m/min, which was used in Example 2, was drawn in the same manner as described in Example 1 except that the heater temperature was varied as indicated in Table 7. A treated cord was prepared form the resulting drawn yarn in the same manner as described in Example 1. The results are shown in Table 8.

It is seen that as the drawing temperature was elevated, the drawability was improved and the crystal perfection index and dimensional stability were enhanced.

TABLE 7

| Run No. | Heater Temperature (°C.) | Draw Ratio | Properties of Drawn Yarn | | | | | | | |
|---|---|---|---|---|---|---|---|---|---|---|
| | | | Tensile Strength (g/d) | Elongation (%) | Intermediate Elongation (%) | Shrinkage Factor (%) under Dry Heat Conditions | Dimensional Stability (%) | Crystal Orientation Degree | Crystal Perfection Index (%) | $T_{max}$ (°C.) |
| 21 | 180 | 3.0 | 8.3 | 16.7 | 8.0 | 5.0 | 13.0 | 88.8 | 61.5 | 108 |
| 22 | 200 | 3.1 | 8.5 | 16.3 | 7.8 | 4.7 | 12.5 | 89.4 | 63.3 | 109 |
| 23 | 220 | 3.2 | 8.9 | 16.3 | 7.7 | 4.5 | 12.2 | 90.4 | 68.7 | 110 |
| 24 | 230 | 3.3 | 9.3 | 16.4 | 7.6 | 4.5 | 12.1 | 91.2 | 70.4 | 111 |
| 25 | 240 | 3.3 | 9.3 | 16.6 | 7.6 | 4.4 | 12.0 | 91.3 | 71.5 | 111 |
| 26 | 250 | 3.4 | 9.4 | 16.0 | 7.5 | 4.3 | 11.8 | 91.8 | 73.3 | 110 |
| 27 | 255 | 3.4 | 9.5 | 16.0 | 7.3 | 4.3 | 11.6 | 91.8 | 74.7 | 110 |
| 28 | 258 | 3.3 | 9.2 | 16.2 | 7.6 | 4.1 | 11.7 | 90.4 | 75.4 | 109 |

TABLE 8

| Run No. | Properties of Treated Cord | | | | | |
|---|---|---|---|---|---|---|
| | Tensile Strength (g/d) | Elongation (%) | Intermediate Elongation (%) | Shrinkage Factor (%) under Dry Heat Conditions | Dimensional Stability (%) | GY Fatigue Life (minutes) |
| 21 | 7.4 | 20.3 | 8.5 | 3.7 | 12.2 | 930 |
| 22 | 7.5 | 20.5 | 8.5 | 3.6 | 12.1 | 910 |
| 23 | 7.7 | 20.0 | 8.4 | 3.6 | 12.0 | 970 |
| 24 | 8.0 | 19.8 | 8.3 | 3.5 | 11.8 | 995 |
| 25 | 8.0 | 20.0 | 8.3 | 3.5 | 11.8 | 980 |
| 26 | 8.1 | 19.9 | 8.1 | 3.4 | 11.5 | 1000 |
| 27 | 8.2 | 20.0 | 7.9 | 3.3 | 11.2 | 960 |
| 28 | 8.0 | 20.1 | 8.3 | 3.1 | 11.4 | 890 |

EXAMPLE 4

The undrawn yarn obtained at a spinning speed of 500 m/min, which was used in Example 2, was drawn according to the drawing method decribed in Example 1. A heater 17 which had a yarn groove 18 formed on the surface thereof and was heat-insulated by a surrounding heat-insulating member 19, as shown in FIG. 4, was arranged between the first and second drawing rollers. The length of the heater was 500 mm and the yarn was travelled through the yarn groove of the heater so that the yarn was not contacted with the heater. The temperature of the heater was adjusted as shown in Table 9. A treated cord was prepared from the resulting drawn yarn in the same manner as described in Example 1. The results are shown in Table 10.

It is seen that in case of the non-contact type heating, the temperature could be elevated and the drawability was improved as compared with the contact type heating.

TABLE 9

| Run No. | Heater Temperature (°C.) | Draw Ratio | Properties of Drawn Yarn | | | | | | | |
|---|---|---|---|---|---|---|---|---|---|---|
| | | | Tensile Strength (g/d) | Elongation (%) | Intermediate Elongation (%) | Shrinkage Factor (%) under Dry Heat Conditions | Dimensional Stability (%) | Crystal Orientation Degree | Crystal Perfection Index (%) | $T_{max}$ (°C.) |
| 29 | 200 | 3.1 | 8.6 | 16.3 | 7.7 | 4.8 | 12.5 | 89.3 | 60.5 | 109 |
| 30 | 220 | 3.2 | 9.0 | 16.2 | 7.5 | 4.6 | 12.1 | 90.4 | 65.8 | 111 |
| 31 | 240 | 3.3 | 9.3 | 15.8 | 7.3 | 4.5 | 11.8 | 91.2 | 70.6 | 111 |
| 32 | 250 | 3.4 | 9.4 | 14.6 | 7.1 | 4.5 | 11.6 | 91.0 | 70.5 | 111 |

TABLE 9-continued

| Run No. | Heater Temperature (°C.) | Draw Ratio | Properties of Drawn Yarn: Tensile Strength (g/d) | Elongation (%) | Intermediate Elongation (%) | Shrinkage Factor (%) under Dry Heat Conditions | Dimensional Stability (%) | Crystal Orientation Degree | Crystal Perfection Index (%) | $T_{max}$ (°C.) |
|---|---|---|---|---|---|---|---|---|---|---|
| 33 | 260 | 3.4 | 9.5 | 14.9 | 7.0 | 4.3 | 11.3 | 91.4 | 71.8 | 111 |
| 34 | 270 | 3.5 | 9.8 | 14.0 | 6.7 | 4.3 | 11.0 | 91.8 | 73.9 | 110 |
| 35 | 275 | 3.5 | 9.7 | 13.9 | 6.8 | 4.2 | 11.0 | 91.8 | 75.5 | 109 |
| 36 | 280 | 3.4 | 9.5 | 13.8 | 6.9 | 3.9 | 10.8 | 90.9 | 75.8 | 108 |

TABLE 10

| Run No. | Properties of Treated Cord: Tensile Strength (g/d) | Elongation (%) | Intermediate Elongation (%) | Shrinkage Factor (%) under Dry Heat Conditions | Dimensional Stability (%) | GY Fatigue Life (minutes) |
|---|---|---|---|---|---|---|
| 29 | 7.6 | 20.3 | 8.5 | 3.6 | 12.1 | 900 |
| 30 | 7.8 | 20.0 | 8.4 | 3.6 | 12.0 | 965 |
| 31 | 8.0 | 19.8 | 8.1 | 3.6 | 11.7 | 950 |
| 32 | 8.0 | 19.0 | 8.0 | 3.5 | 11.5 | 970 |
| 33 | 8.2 | 19.1 | 7.8 | 3.4 | 11.2 | 870 |
| 34 | 8.4 | 18.9 | 7.6 | 3.4 | 11.0 | 900 |
| 35 | 8.2 | 18.5 | 7.6 | 3.2 | 10.8 | 850 |
| 36 | 8.0 | 18.9 | 7.8 | 3.0 | 10.8 | 880 |

EXAMPLE 5

A chip of polyhexamethylene adipamide having a formic acid relative viscosity shown in Table 11 was melted in an extruder and the melt was spun from a spinneret having 624 orifices having a diameter of 0.25 mm at 305° C. The spun yarn was passed through a heating cylinder heated at 350° C. and having a length of 150 mm and was then cooled and treated with steam. Then, an oiling agent was applied to the yarn, and the yarn was taken up on a take-up roller rotated at a speed of 1400 m/min and was then wound at the same speed as the take-up speed. Then, the undrawn yarn was stretched by 1% between a feed roller maintained at room temperature and the first drawing roller maintaied at 105° C., and the yarn was drawn at a draw ratio shown in Table 11 between the first drawing roller and the second drawing roller maintained at 220° C. A hot plate heater of the contact type maintained at 240° C. and having a length of 250 mm was arranged between the first and second drawing rollers. The drawing speed 12 m/min. The properties

TABLE 11

| Run No. | Formic Acid Relative Viscosity | Draw Ratio | Properties of Drawn Yarn: Tensile Strength (g/d) | Elongation (%) | Intermediate Elongation (%) | Shrinkage Factor (%) under Dry Heat Conditions | Dimensional Stability (%) | Crystal Orientation Degree | Crystal Perfection Index (%) | $T_{max}$ (°C.) |
|---|---|---|---|---|---|---|---|---|---|---|
| 37 | 50 | 3.4 | 9.1 | 15.9 | 7.2 | 4.2 | 11.4 | 91.2 | 73.9 | 111 |
| 38 | 60 | 3.3 | 9.2 | 16.2 | 7.4 | 4.4 | 11.8 | 91.1 | 71.8 | 112 |
| 39 | 70 | 3.3 | 9.4 | 16.6 | 7.6 | 4.6 | 12.2 | 91.3 | 71.0 | 111 |
| 40 | 80 | 3.3 | 9.5 | 16.6 | 7.6 | 4.6 | 12.2 | 91.6 | 68.9 | 112 |
| 41 | 90 | 3.2 | 9.3 | 16.8 | 7.7 | 4.7 | 12.4 | 91.0 | 67.8 | 111 |
| 42 | 100 | 3.0 | 8.7 | 17.0 | 8.0 | 4.6 | 12.6 | 88.9 | 65.6 | 109 |

TABLE 12

| Run No. | Properties of Treated Cord: Tensile Strength (g/d) | Elongation (%) | Intermediate Elongation (%) | Shrinkage Factor (%) under Dry Heat Conditions | Dimensional Stability (%) | GY Fatigue Life (minutes) |
|---|---|---|---|---|---|---|
| 37 | 7.8 | 18.5 | 8.1 | 3.3 | 11.4 | 490 |
| 38 | 7.9 | 20.0 | 8.3 | 3.4 | 11.7 | 880 |
| 39 | 8.0 | 20.3 | 8.4 | 3.6 | 12.0 | 1310 |
| 40 | 8.1 | 20.2 | 8.4 | 3.7 | 12.1 | 1930 |
| 41 | 8.0 | 20.5 | 8.5 | 3.8 | 12.3 | 2450 |
| 42 | 7.7 | 21.5 | 8.9 | 3.8 | 12.7 | 2230 |

COMPARATIVE EXAMPLE 2

The undrawn yarn prepared in Example 5 was taken up by the first Nelson roller and consecutively guided to the second through fourth Nelson rollers where the peripheral rotation speed was gradually increased so that the drawn heat setting was performed in three stages. The yarn was wound at a speed of 1500 m/min. The first through fourth Nelson rollers consisted of Goddet roller pairs G1 through G4, respectively. The Goddet roller pairs G1 through G4 were maintained at room temperature, 80° C., 220° C. and 230° C., respectively. The peripheral speed ratio G2/G1 between the Goddet roller pairs G2 and G1 was 1.01, the peripheral speed ratio G3/G2 between the Goddet roller pairs G3 and G2 was variable, the peripheral speed ratio G4/G3 between the Goddet roller pairs G4 and G3 was 1.6, and the ratio of the winding speed to the peripheral speed of the Goddet roller pair G4 was 0.95. The obtained drawn yarn was treated in the same manner as described in Example 1 to obtain a treated cord. The results are shown in Tables 13 and 14.

It is seen that the tensile strength, crystal perfection index, dimensional stability and fatigue resistance were lower than those obtained in Example 5.

TABLE 13

| Run No. | Formic Acid Relative Viscosity | Draw Ratio | Properties of Drawn Yarn: Tensile Strength (g/d) | Elongation (%) | Intermediate Elongation (%) | Shrinkage Factor (%) under Dry Heat Conditions | Dimensional Stability (%) | Crystal Orientation Degree | Crystal Perfection Index (%) | $T_{max}$ (°C.) |
|---|---|---|---|---|---|---|---|---|---|---|
| Comparison 3 | 50 | 3.3 | 8.7 | 13.5 | 8.0 | 5.0 | 13.0 | 89.5 | 58.8 | 113 |
| Comparison 4 | 60 | 3.2 | 8.8 | 13.6 | 8.2 | 5.1 | 13.3 | 89.3 | 55.8 | 113 |
| Comparison 5 | 70 | 3.2 | 9.0 | 13.8 | 8.4 | 5.3 | 13.7 | 89.9 | 52.1 | 113 |
| Comparison 6 | 80 | 3.1 | 8.9 | 14.0 | 8.5 | 5.3 | 13.8 | 90.3 | 50.9 | 113 |
| Comparison 7 | 90 | 3.1 | 8.9 | 13.9 | 8.5 | 5.5 | 14.0 | 90.7 | 49.7 | 112 |
| Comparison 8 | 100 | 2.8 | 8.2 | 14.5 | 8.9 | 5.5 | 14.4 | 87.9 | 43.8 | 109 |

TABLE 14

| Run No. | Properties of Treated Cord: Tensile Strength (g/d) | Elongation (%) | Intermediate Elongation (%) | Shrinkage Factor (%) under Dry Heat Conditions | Dimensional Stability (%) | GY Fatigue Life (minutes) |
|---|---|---|---|---|---|---|
| Comparison 3 | 7.4 | 18.0 | 8.2 | 3.8 | 12.0 | 360 |
| Comparison 4 | 7.5 | 18.3 | 8.5 | 3.9 | 12.4 | 700 |
| Comparison 5 | 7.6 | 18.5 | 8.6 | 4.1 | 12.7 | 980 |
| Comparison 6 | 7.6 | 18.8 | 8.6 | 4.7 | 13.3 | 1260 |
| Comparison 7 | 7.5 | 18.8 | 8.8 | 5.0 | 13.8 | 1510 |
| Comparison 8 | 7.0 | 18.5 | 8.8 | 5.2 | 14.0 | 1430 |

EXAMPLE 6

The undrawn yarn used in Example 3 was stretched by 1% between a feed roller maintained at room temperature and the first drawing roller maintained at 90° C. and was drawn at a draw ratio of 2.0 between the first drawing roller and the second drawing roller maintained at 200° C. Then, the drawn yarn was further drawn at a drawn ratio of 1.6 between the second drawing roller and the third drawing roller maintained at 200° C. and then wound. A hot plate heater of the contact type maintained at 235° C. and having a length of 250 mm was arranged between the first and second drawing rollers, and a hot plate heater of the contact type maintained at 245° C. and having a length of 250 mm was arranged between the second and third drawing rollers. The drawing speed was 20 m/min. The obtained drawn yarn had a tensile strength of 9.4 g/d, an elongation of 16.0%, an intermediate elongation of 7.5%, a shrinkage factor of 4.4% under dry heat conditions and a dimensional stability of 11.1%. The drawn yarn was dip-treated in the same manner as described in Example 1 to obtain a treated cord having a tensile strength of 8.0 g/d, an elongation of 20.2%, an intermediate elongation of 8.2%, a shrinkage factor of 3.5% under dry heat conditons, a dimensional stability of 11.7% and a GY fatigue life of 980 minutes.

I claim:

1. A high-tenacity polyhexamethylene adipamide fiber having a formic acid relative viscosity of 50 to 150, a tensile strength of at least 7.5 g/d and an elongation of 12 to 20%, said fiber being characterized by having (1) an intermediate elongation not larger than 8% under a stress of 5.3 g/d, (2) a difference between elongation (%) at break and intermediate elongation (%) under 5.3 g/d of at least 6%, (3) a shrinkage factor not larger than 5% under dry heat conditions at 160° C., (4) a crystal perfection index of at least 60% and (5) a peak temperatures Tmax of the dynamic mechanical loss tangent (tan $\epsilon$) as measured at a frequency of 110 Hz satisfying the requirement of the following formula:

$$100 \leqq Tmax + 4(9.5 - DS) \leqq 116$$

wherein DS stands for the tensile strength (q/d).

2. A polyhexamethylene adipamide fiber as set forth in claim 1, wherein the formic acid relative viscosity is in the range of 60 to 100.

3. A polyhexamethylene adipamide fiber as set forth in claim 1, which is further characterized by having a crystal orientation degree of at least 0.85 but not larger than 0.92.

* * * * *